US007527355B2

(12) United States Patent
Lee et al.

(10) Patent No.: US 7,527,355 B2
(45) Date of Patent: May 5, 2009

(54) ARRAY TYPE PRINTHEAD AND INKJET IMAGE FORMING APPARATUS HAVING THE SAME

(75) Inventors: Young-su Lee, Yongin-si (KR); In-su Lee, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 11/469,981

(22) Filed: Sep. 5, 2006

(65) Prior Publication Data

US 2007/0064048 A1 Mar. 22, 2007

(30) Foreign Application Priority Data

Sep. 22, 2005 (KR) ..... 10-2005-0088319

(51) Int. Cl.
*B41J 2/14* (2006.01)

(52) U.S. Cl. ..... 347/49; 347/42

(58) Field of Classification Search ..... 347/13, 347/42, 49

See application file for complete search history.

(56) References Cited

U.S. PATENT DOCUMENTS 5,771,052 A * 6/1998 Hine et al. ..... 347/42
6,488,422 B1 * 12/2002 Silverbrook ..... 400/56
2005/0157065 A1 * 7/2005 Silverbrook et al. ..... 347/42
2007/0013739 A1 * 1/2007 Silverbrook ..... 347/54

FOREIGN PATENT DOCUMENTS

| | | |
|---|---|---|
| CN | 1513673 | 7/2004 |
| CN | 1551831 | 12/2004 |
| JP | 60-141565 | 7/1985 |
| JP | 09-48147 | 2/1997 |
| KR | 97-004234 | 3/1997 |

OTHER PUBLICATIONS

Chinese Office Action dated Jun. 6, 2008 issued in CN 2006101592242.

* cited by examiner

*Primary Examiner*—Matthew Luu
*Assistant Examiner*—Justin Seo
(74) *Attorney, Agent, or Firm*—Stanzione & Kim, LLP

(57) ABSTRACT

An array printhead and an inkjet image forming apparatus having the same are include a first member, a second member, a third member, and a support member. The first through third members and the support member sequentially overlap and couple to each other. The first member supplies ink of different colors into the second member and the second member separately receives the ink of different colors supplied from the first member. The third member includes a plurality of head chips that eject ink supplied from the second member thereon and the support member fixes the first member, the second member, and the third member using a plurality of coupling elements.

21 Claims, 7 Drawing Sheets

ARRAY TYPE PRINTHEAD AND INKJET IMAGE FORMING APPARATUS HAVING THE SAME

CROSS-REFERENCE TO RELATED APPLICATIONS

This application claims priority under 35 U.S.C. § 119(a) from Korean Patent Application No. 10-2005-0088319, filed on Sep. 22, 2005, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus having an array printhead formed with a nozzle unit having a length that corresponds to a width of a printing medium.

2. Description of the Related Art

An inkjet image forming apparatus is an apparatus for ejecting ink to form an image using a shuttle type printhead spaced apart from a front surface of paper and performing a reciprocating motion in a direction perpendicular to a feeding direction of the paper. The printhead includes a nozzle unit where a plurality of nozzles that eject ink are formed.

Recently, attempts are being made to achieve a high-speed printing using a line type printhead having a nozzle unit of a length that corresponds to a width of paper instead of a printhead that reciprocates in a width direction of the paper. In the above inkjet image forming apparatus, since the printhead is fixed and only paper is delivered, a driving mechanism is simple and a high-speed printing may be achieved.

FIG. 1 is a cross-sectional view illustrating a conventional printhead.

Referring to FIG. 1, a body 1 formed of ceramic material includes a mounting part 3 in which a manifold 2 may be mounted. The manifold 2 includes a space through which ink is supplied. The manifold 2 includes one inlet port 4 and two outlet ports 5 and 6, which are located with a predetermined interval so that ink may flow therethrough. Ink that enters through the inlet port 4 flows to an ink cartridge (not shown) through the outlet ports 5 and 6, so that ink circulates.

A nozzle unit 7 having a plurality of nozzles (not shown) is attached on one side of the manifold 2 and a printed circuit board (PCB) 8 is attached on the other side (i.e., the opposite side) of the manifold 2. The nozzle unit 7 is electrically connected to the PCB 8 to eject ink under the control of the PCB.

To form a color image, the conventional printhead has a structure where four manifolds 2 are mounted with a predetermined interval in the body 1. The manifolds 2 supply ink of colors Y (yellow), C (cyan), M (magenta), and K (black), respectively, to allow the ink to be ejected to an outside of the printhead through the nozzle unit 7, so that the color image is formed.

However, a size of the body 1 formed of ceramic material is excessively large and the manifold 2 for supplying ink within the body 1 are formed of metal such as aluminum, so that manufacturing costs increase. Also, since a planarization degree of the body 1 should be managed for attachment of the nozzle unit 7 thereon, additional processes of locating a Ni-plate on the manifold 2 and then attaching the nozzle unit 7 to the manifold 2 are required, which increases the manufacturing costs.

SUMMARY OF THE INVENTION

The present general inventive concept provides an array printhead and an inkjet image forming apparatus having the same capable of maintaining a planarization degree of the printhead to secure printing quality by mechanically coupling a plurality of members that constitute the printhead to a metal support member thereof.

Additional aspects and advantages of the present general inventive concept will be set forth in part in the description which follows and, in part, will be obvious from the description, or may be learned by practice of the general inventive concept.

The foregoing and other aspects of the present general inventive concept may be achieved by providing an array printhead including a first member to supply ink of different colors into a second member, the second member to separately receive the ink of different colors supplied from the first member, a third member having a plurality of head chips that eject ink supplied from the second member thereon, and a support member to fix the first member, the second member, and the third member using a plurality of coupling elements, wherein the first through third members and the support member sequentially overlap and couple to each other.

The foregoing and other aspects of the present general inventive concept may also be achieved by providing an array printhead including a support member having a main plate and fixing portions extended from both sides of the main plate, and one or more members disposed between the fixing portions, coupled to the main plate, and to direct ink received from the supporting member in an ink supply direction along a first direction, to direct the ink received along the first direction in a second direction, and to direct the ink received along the second direction in one or more nozzle lines.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
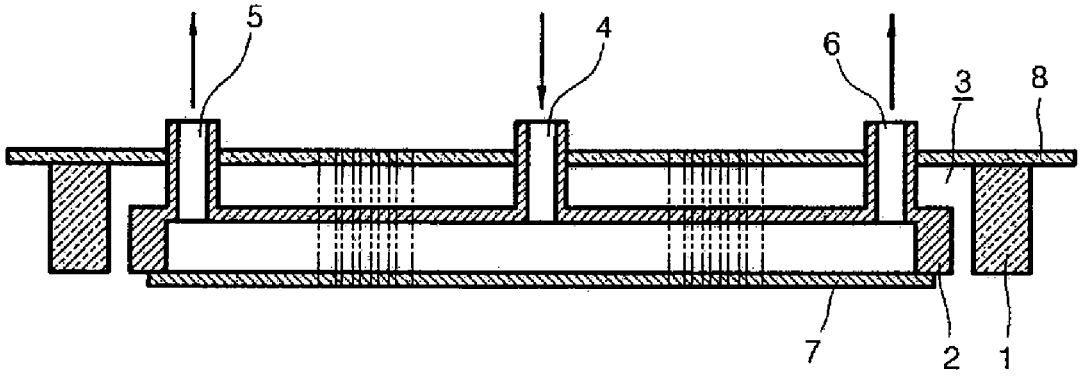
FIG. 1 is a cross-sectional view illustrating a conventional printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
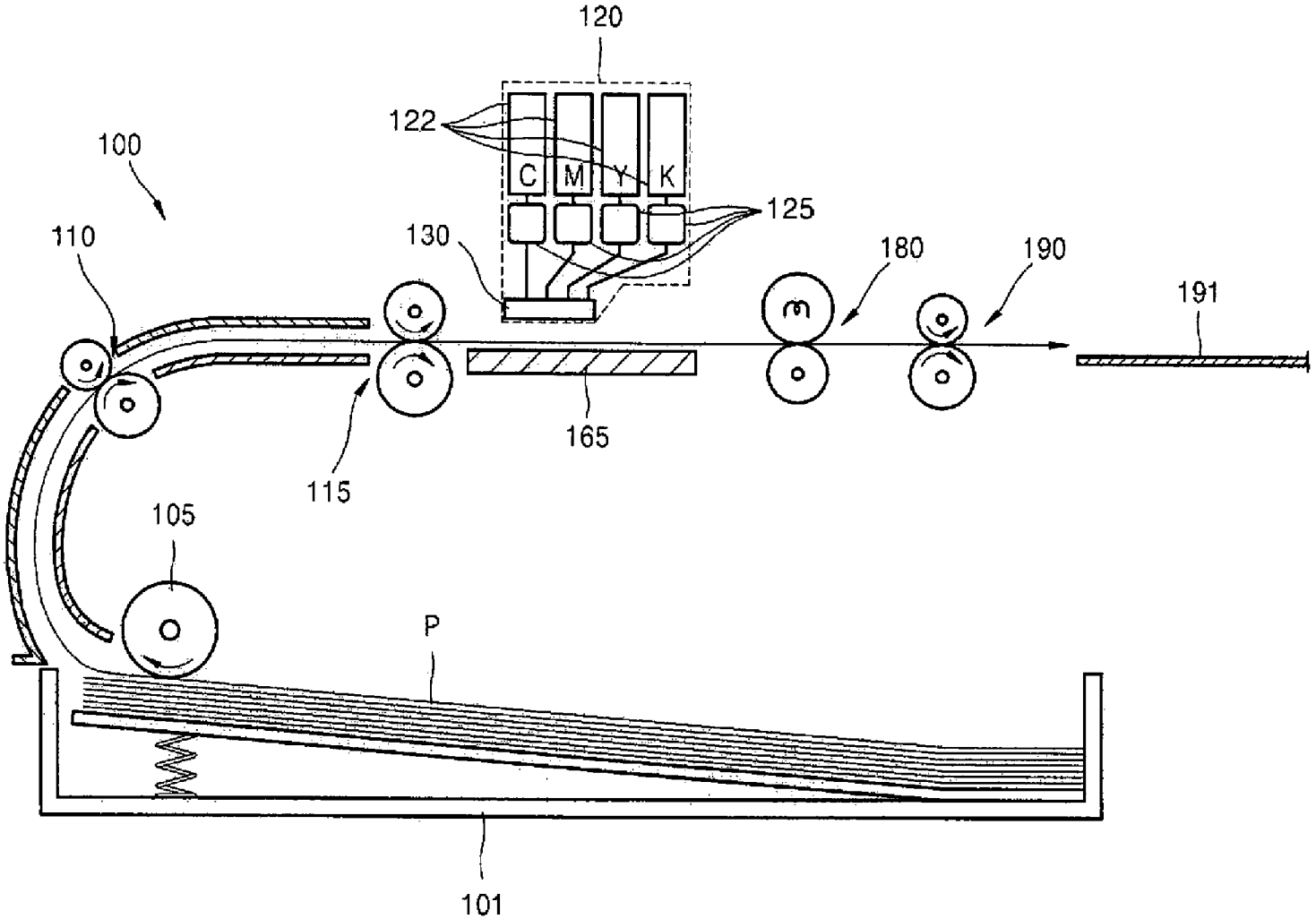
FIG. 2 is a sectional view illustrating an inkjet image forming apparatus according to an embodiment of the present invention.

FIG. 2 is a view illustrating an inkjet image forming apparatus 100 according to an embodiment of the present general inventive concept. Referring to FIG. 2, the inkjet image forming apparatus 100 includes a paper-feeding part that feeds a printing medium, such as paper P, in one direction and an array printhead 130 to eject ink onto the paper P to form an image.

The paper-feeding part includes a feeding roller 110 feeding paper P such that the paper P may pass through below the array printhead 130, and discharging rollers 190 discharging the paper P on which an image is formed by ink ejection to a paper-discharging tray 191.

The feeding roller 110 and the discharging rollers 190 respectively have a driving roller and a driven roller in pair which are pressed to come into contact with each other. The paper P progresses through a contact surface formed between the pair of rollers. A reference number 115 is a registration roller for to align the paper P so as to form the image on a desired portion of the paper P.

The inkjet image forming apparatus 100 includes a paper-feed cassette 101 stacking the paper P, and a pickup roller 105 to pick up the paper P stacked in the paper-feed cassette 101 sheet by sheet. Also, the apparatus 100 further includes a drier 180 to dry the image formed on the paper P by ink ejection. Since the apparatus 100 having the array printhead 130 prints the image in high speed, the paper P is not sufficiently dried and continuously stacked in the paper-discharging tray 191, which may cause ink spread. The drier 180 rapidly dries the image to prevent a printing defect due to the ink spread.

An ink cartridge 120 is located between the registration roller 115 and the drier 170.

The ink cartridge 120 includes four ink tanks 122C, 122M, 122Y, and 122K to respectively receive ink of four colors of cyan (C), magenta (M), yellow (Y), and black (K), four negative pressure regulators 125C, 125M, 125Y, and 125K, and the array printhead 130 therein.

The negative pressure regulators 125C, 125M, 125Y, and 125K regulate negative pressures of ink flowing to the array printhead 130 from the four ink tanks 122C, 122M, 122Y, and 122K to prevent air bubbles from penetrating into an inside of the array printhead 130 or prevent ink from leaking out unnecessarily.

A platen 165 is located below the array printhead 130 to support the paper P passing through below the array printhead 130. By the platen 165, a uniform interval is maintained between the array printhead 130 and the paper P passing through below the array printhead 130.

Figure 3:
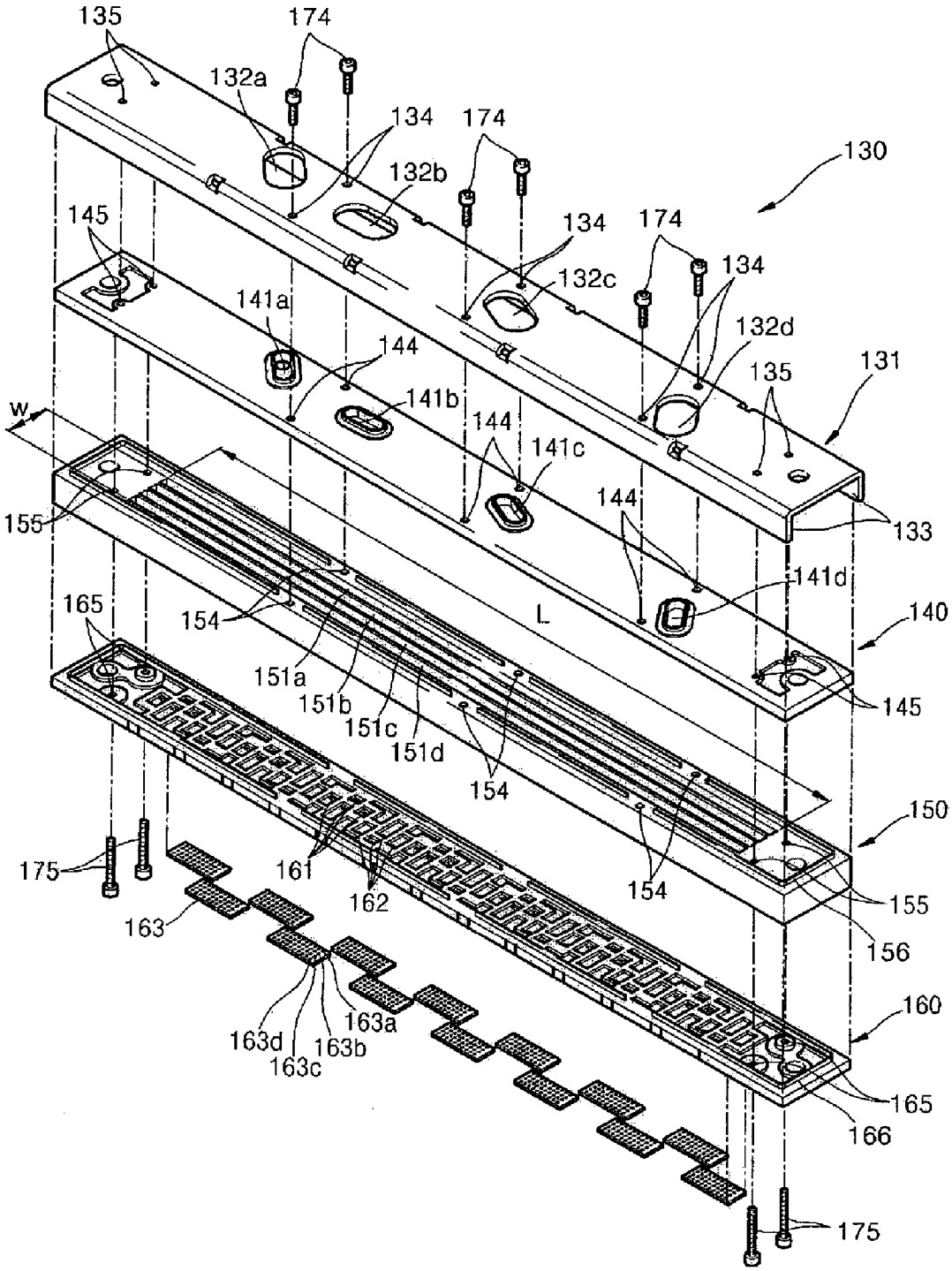
FIG. 3 is an exploded perspective view illustrating an array printhead of FIG. 1.
Figure 4:
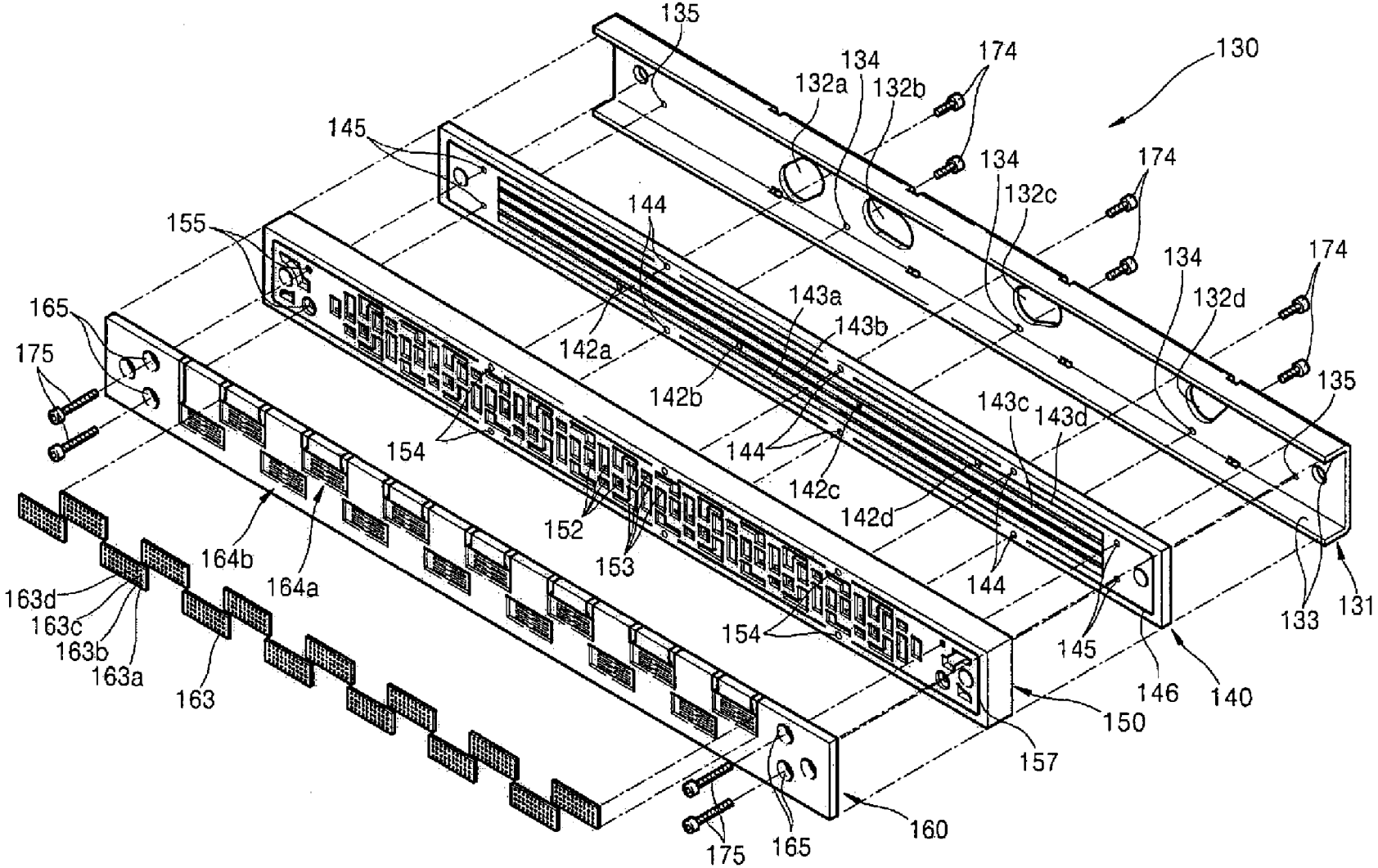
FIG. 4 is an exploded perspective view illustrating a backside of the array printhead of FIG. 3.

Referring to FIGS. 3 and 4, the array printhead 130 includes a support member 131, a first member 140, a second member 150, and a third member 160, which sequentially overlap and couple to each other.

The first, second, and third members 140, 150, and 160 are formed by molding liquid crystal polymer, which is a polymer resin. The liquid polymer has excellent molding property and excellent chemical durability and is strong against twisting due to an external force. The liquid polymer is a material having excellent measurement stability and thus is appropriate for the array printhead 130 requiring a high-level planarization degree and a high-level measurement accuracy.

The first member 140 includes four inlet holes 141*a*, 141*b*, 141*c*, and 141*d* formed to allow ink of four colors of cyan, magenta, yellow, and black from the four negative pressure regulators 125C, 125M, 125Y, and 125K (refer to FIG. 2) to flow into the inside of the array printhead 130 (i.e., second four channels 151*a*, 151*b*, 151*c*, and 151*d* of the second member 150). In detail, the ink of cyan, magenta, yellow, and black may flow through the first inlet hole 141*a*, the second inlet hole 141*b*, the third inlet hole 141*c*, and the fourth inlet hole 141*d*, respectively. First four channels 143*a*, 143*b*, 143*c*, and 143*d* to separately receive the ink of four colors of C, M, Y, and K through the four inlet holes 141*a*, 141*b*, 141*c*, and 141*d*, respectively, are formed in a lower surface of the first member 140. Through holes 142*a*, 142*b*, 142*c*, and 142*d* communicating with the inlet holes 141*a*, 141*b*, 141*c*, and 141*d*, respectively are formed in the first four channels 143*a*, 143*b*, 143*c*, and 143*d*, respectively.

The second four channels 151*a*, 151*b*, 151*c*, and 151*d* to separately receive the ink of four colors of C, M, Y, and K through the four through holes 142*a*, 142*b*, 142*c*, and 142*d*, respectively, are formed in an upper surface of the second member 150. The second four channels 151*a*, 151*b*, 151*c*, and 151*d* are mutually parallel to a width direction of paper, i.e., a length direction of the array printhead 130. The second four channels 151*a*, 151*b*, 151*c*, and 151*d* may receive cyan ink, magenta ink, yellow ink, and black ink, respectively.

The first four channels 143*a*, 143*b*, 143*c*, and 143*d* are formed in the lower surface of the first member 140 in the same pattern as in the upper surface of the second member 150. With this construction, the first four channels 143*a*, 143*b*, 143*c*, and 143*d* of the first member 140 face corresponding ones of the second four channels 151*a*, 151*b*, 151*c*, and 151*d* of the second member 150, so that sufficient ink receiving spaces may be provided for the ink of four colors of C, M, Y, and K, respectively.

A rib 156 protrudes from a periphery of the upper surface of the second member 150 and a groove 146 is formed in a periphery of the lower side of the first member 140 to receive the rib 156. The rib 156 and the groove 146 serve as references when the first member 140 and the second member 150 are attached to each other.

A plurality of second path grooves 161 and 162 serving as a flowing path of ink that has flowed from the second member 150 are formed in an upper surface of the third member 160. The array printhead 130 includes a plurality of head chips 163 arranged in a zigzag pattern to the width direction of the paper (i.e., the length direction of the array printhead 130), so that the head chips 163 form a plurality of head chip lines. Therefore, a plurality of head chip mounting parts 164*a* and 164*b* are provided in the zigzag pattern on a lower surface of the third member 160 to form another head chip lines to receive corresponding ones of the head chips 163 according to the head chip lines of the head chips 163.

To supply the ink to the head chip mounting parts 164*a* and 164*b*, respectively, the plurality of second path grooves 161 and 162 of the third member 160 are repeatedly formed in the length direction of the array printhead 130 to correspond to the arrangement of the head chips 163. That is, the plurality of path grooves 161 and 162 are formed in the zigzag pattern. Therefore, cyan ink, magenta ink, yellow ink, and black ink are respectively supplied to a first nozzle line 163*a*, a second nozzle line 163*b*, a third nozzle line 163*c*, and a fourth nozzle line 163*d* formed on the head chip 163. Ink of four colors is supplied to one chip, so that '1-head chip for 4-colors' is achieved. First path grooves 152 and 153 are formed on the lower surface of the second member 150 in the same pattern as the pattern of the second path grooves 161 and 162 of the third member 160.

A second rib 166 protrudes from a periphery of the upper surface of the third member 160 and a second groove 157 is formed in a periphery of the lower side of the second member 150 to receive the second rib 166. The second rib 166 and the second groove 157 serve as references when the second member 150 and the third member 160 are attached to each other. The second rib 166 and the second groove 157 suppress or prevent bending and twisting of the second member 150 and the third member 160, thereby sealing between the second member 150 and the third member 160.

The support member 131 includes a plurality of through holes 132*a*, 132*b*, 132*c*, and 132*d* that correspond to the inlet holes 141*a*, 141*b*, 141*c*, and 141*d* of the first member 140. Therefore, since the inlet holes 141*a*, 141*b*, 141*c*, and 141*d* communicate with the plurality of through holes 132*a*, 132*b*, 132*c*, and 132*d* when the first member 140 overlaps the support member 131, the ink is allowed to be supplied from the ink tanks 122C, 122M, 122Y, and 122K to the first member 140 through the supporting member 131.

Figure 5:
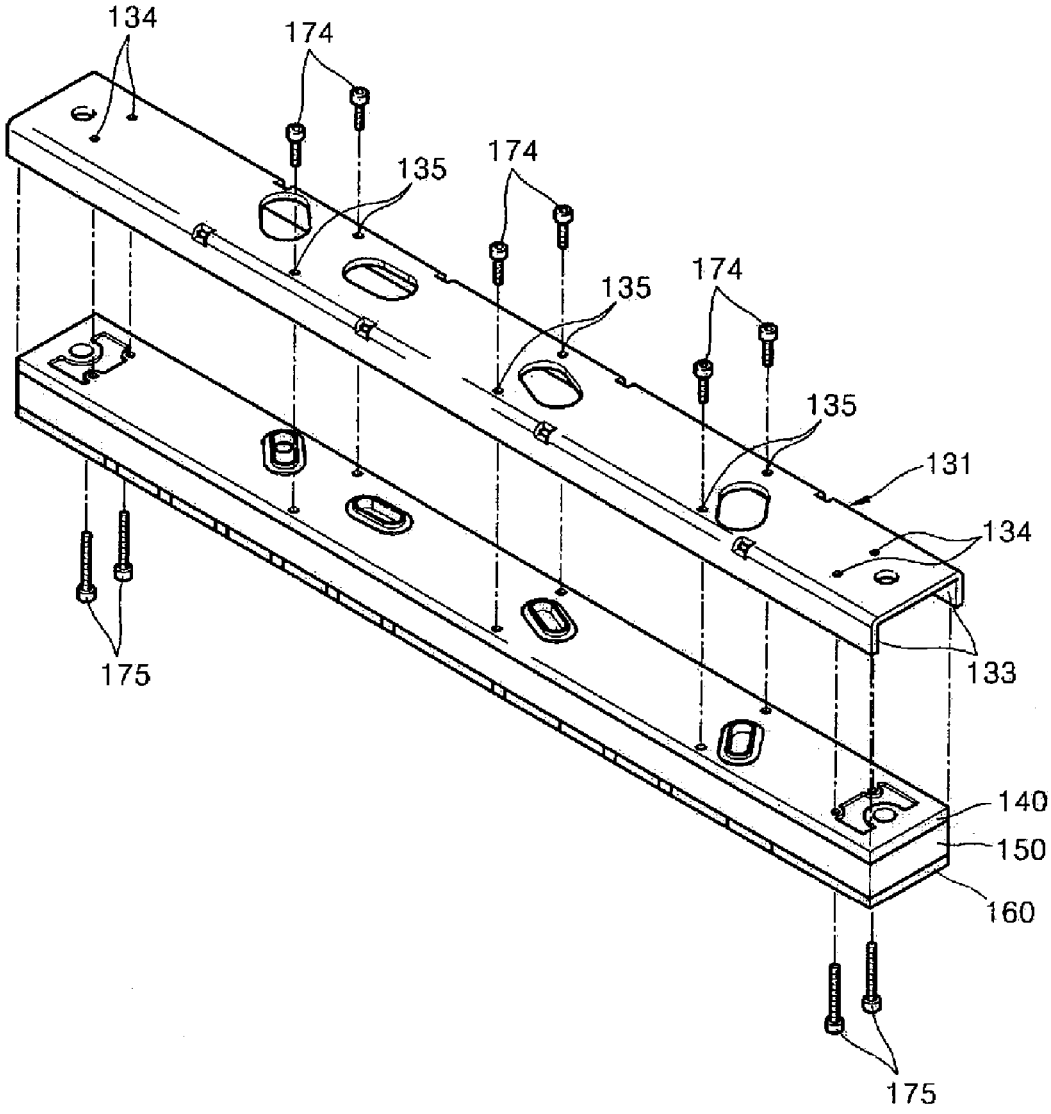
FIG. 5 is an exploded perspective view illustrating a support member and members overlapping each other of the array printhead of FIG. 2.
Figure 6:
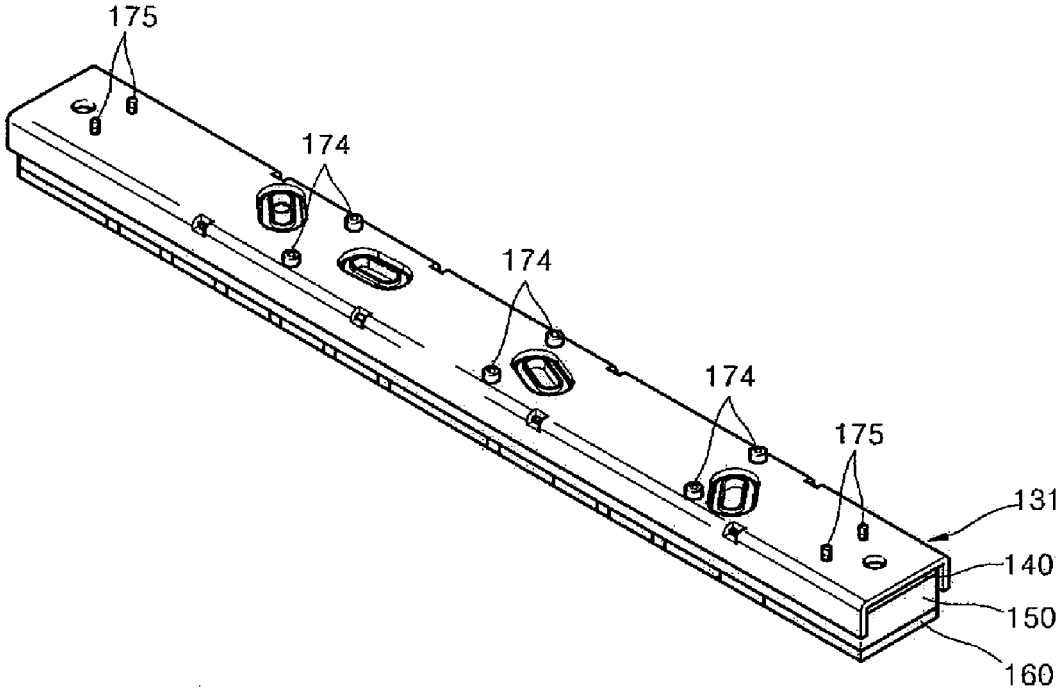
FIG. 6 is an assembled perspective view illustrating the array printhead of FIG. 2.
Figure 7:
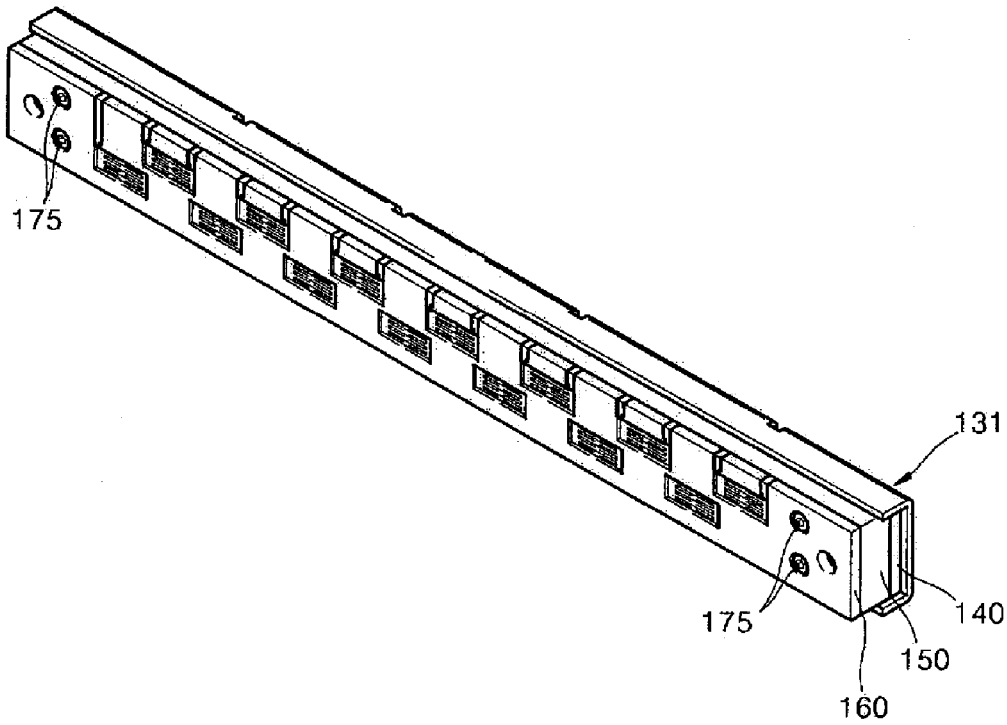
FIG. 7 is a view illustrating the backside of the array printhead of FIGS. 3 and 4.

Referring to FIGS. 3 and 5, the support member 131 includes a main plate formed with the through holes 132*a*, 132*b*, 132*c*, and 132*d*, and a plurality of fixing portions 133 extending from opposite sides of the main plate by a predetermined length in a direction perpendicular to a length direction of the support member 131. Therefore, referring to FIGS. 6 and 7, the first member 140 and the second member 150 are fitted between the plurality of fixing portions 133 when the first and second members 140 and 150 overlap and couple to the support member 131.

Figure 8:
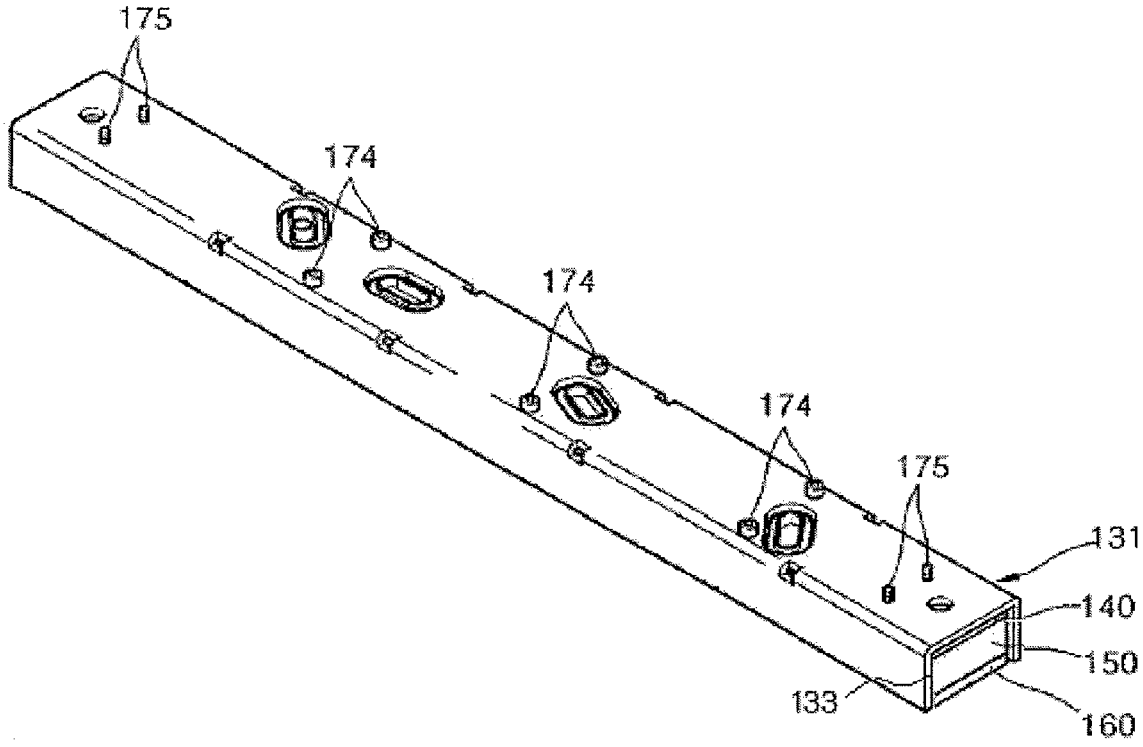
FIG. 8 is an assembled perspective view illustrating another exemplary embodiment of the array print head of FIG. 2.

According to the present embodiment, predetermined portions of the first and second members 140 and 150 are fitted between the plurality of fixing portions 133. The first and second members 140 and 150 may be fitted between the plurality of the fixing portions 133, or all of the first, second, and third members 140, 150, and 160 may be fitted between the plurality of fixing portions 133. Referring to FIG. 8, the array printhead 130 is similar to the array printhead 130 of FIG. 6, however a distance of the fixing portions 133 extend in a coupling direction of the first, second, and third members 140, 150, and 160 to correspond to a sum of thicknesses of the first, second, and third members 140, 150, and 160 in the coupling direction.

The first, second, and third members 140, 150, and 160 are vertically coupled to the support member 131 using a coupling element. For that purpose, the coupling element includes first coupling parts 174 that sequentially couple the support member 131, the first member 140, and the second member 150 vertically from an upper side of the support member 131 to the third member, and second coupling parts 175 that sequentially couple the third member 160, the second member 150, the first member 140, and the support member 131 vertically from a lower side of the third member 160 to a lower side of the support member 131. The first and second coupling parts 174 and 175 may be screws.

The support member 131 includes first and second coupling holes 134 and 135. The first member 140 includes the first and second coupling holes 144 and 145, the second member 150 includes the first and second coupling holes 154 and 155, and the third member 160 includes the second coupling holes 165. Accordingly, the first coupling part 174 is coupled in the first coupling holes 134, 144, and 154, and the second coupling part 175 is coupled in the second coupling holes 135, 145, 155, and 165.

The first coupling hole 154 is provided in plural with a predetermined interval on both side portions of the second member 150 in a widthwise direction of the ink channels 151*a*, 151*b*, 151*c*, and 151*d* in the second member 150. At this point, the first coupling holes 154 are formed not to interfere with the rib 156. To correspond to the first coupling holes 154 in the second member 150, the first coupling holes 134 and 144 are formed in the support member 131 and the first member 140, respectively. The first coupling part 174 is sequentially coupled in the first coupling holes 134, 144, and 154, so that the first and second members 140 and 150 are coupled and fixed to the support member 131.

The second coupling hole 155 is provided in plural on both side portions of the second member 150 in a lengthwise direction of ink channels 151*a*, 151*b*, 151*c*, and 151*d* in the second member 150. To correspond to the second coupling holes 155 in the second member 150, the second coupling holes 135, 145 and 165 are formed in the support member 131, the first member 140, and the third member 160, respectively. The second coupling part 175 is sequentially coupled in the second coupling holes 165, 155, 145 and 135, so that the first, second, and third members 140, 150 and 160 are coupled and fixed to the support member 131.

The members 140, 150, and 160 may be formed of liquid crystal polymer and the support member 131 may be formed of stainless steel (SUS).

Though the members 140, 150, and 160 are formed of liquid crystal polymer having excellent planarization degree, a length of the array printhead 130 is larger than a vertical length (i.e., 210 mm) of paper A4. Accordingly, when the array printhead is injection-molded, it is difficult to maintain constant an interval between the printhead and the paper in the length direction. However, since the support member 131 is formed of metal, thus has excellent strength and the planarization degree of the support member 131 may be managed, it is possible to prevent the members 140, 150, and 160 from bending by fixing the members 140, 150, and 160 using the coupling element. Accordingly, it is possible to maintain a planarization degree by suppressing, or preventing the bending of the members 140, 150, and 160.

As described above, the array printhead and the inkjet image forming apparatus having the same have the following effects.

First, the support member formed of stainless steel having excellent planarization degree and excellent strength is used, so that a bending defect generated when the respective members are injection-molded may be improved.

Second, the interval between the printhead and the paper may be maintained constant, so that a smear phenomenon and a paper jam are prevented and thus printing quality is improved.

Third, deformation of the respective members due to heat generated from the printhead may be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image forming apparatus comprising:

a paper delivery element to deliver a printing medium in a direction; and an array printhead to eject ink onto the printing medium to form an image, the array printhead including:

a first member supplying ink of different colors;

a second member to separately receive the ink of different colors supplied from the first member;

a third member having a plurality of head chips arranged in a plurality of rows and each having a plurality of nozzles to eject ink of different colors supplied from the second member thereon; and a support member to fix the first member, the second member, and the third member using a plurality of coupling elements, wherein the first, second, and third members and the support member sequentially overlap and couple to each other, the support member overlapping an entire longitudinal length of at least two sides of the first, second and third members.

2. The apparatus of claim 1, wherein the support member comprises a plurality of fixing portions extending perpendicularly along a length direction of the support member.

3. The apparatus of claim 1, wherein the coupling elements comprise a first coupling part that couples the first, second, and third members sequentially from an upper said of the support member and a second coupling part that couples each of the third, second, and first members to the support member.

4. The apparatus of claim 3, wherein the support member and each of the first, second, and third members have a plurality of coupling holes formed in both side portions of a length thereof, and the second coupling part is coupled in the plurality of coupling holes.

5. The apparatus of claim 3, wherein the support member, the first and second members have a plurality of coupling holes formed in both side portions of a width thereof, and the first coupling part is coupled in the plurality of coupling holes.

6. The apparatus of claim 1, wherein the support member is formed of stainless steel.

7. The apparatus of claim 1, wherein the support member comprises a main plate and fixing portions extended from opposite sides of the main plate along a length of the main plate by a distance to receive the first, second, and third members therebetween.

8. The apparatus of claim 7, wherein the fixing portions extend toward the first, second, and third members.

9. The apparatus of claim 7, wherein the distance of the fixing portions corresponds to a sum of thicknesses of the first, second, and third members wherein the sum of thickness of the first, second, arid third members is defined as the sequential coupling of the first, second, and third members respectively.

10. The apparatus of claim 7, wherein the main plate has the length and a width corresponding to a distance between the fixing portions, and the first, second, and third members have a second width narrower than the width of the main plate.

11. The apparatus of claim 7, wherein the first, second, and third members are disposed within the fixing portions and coupled to the supporting member in order.

12. The apparatus of claim 1, further comprising;

a through hole formed on the supporting member;

channels formed on at least one of the first member and the second member to direct the ink from corresponding ones of the through holes in a first direction;

path grooves formed on at least one of the second member and the third member to direct the ink from corresponding ones of the channels in a second direction having an angle with the first direction.

13. The apparatus of claim 12, further comprising;

inlet holes formed on the first member to receive the ink from the supporting member in an ink supplying direction perpendicular to the first and second directions.

14. The apparatus of claim 13, wherein the head chips eject ink in the same direction as the ink supplying direction perpendicular to the first and second directions.

15. The apparatus of claim 12, further comprising;

second channels formed on the other one of the first member and the second member to correspond to the respective channels, wherein the channels and second channels are sealed when the first member and the second member are coupled using a sealing member.

16. The apparatus of claim 15, further comprising;

a rib formed on one of the first member and the second member; and a groove formed on the other one of the first member and the second member, wherein the first and second members are sealed by the rib and groove.

17. The apparatus of claim 12, further comprising;

second path grooves formed on the other one of the second member and the third member to correspond to the respective path grooves, wherein the path grooves and the second grooves are sealed when the second member and the third member are coupled using a sealing member.

18. The apparatus of claim 17, further comprising;

a rib formed on one of the second member and the third member; and a groove formed on the other one of the second member and the third member, when the second and third members are sealed by the rib and groove.

19. The apparatus of claim 1, wherein:

the supporting member and the first, second, and third member comprise first opposite sides and second opposite sides;

first coupling holes are formed on the first opposite sides of the supporting member and the first, second, and third members such that the supporting member and the first and second members are coupled in order, second coupled holes are formed on the second opposite sides of the supporting member and the first, second, and third members such that the third member, the second member, the first member, and the supporting members are coupled in order.

20. The apparatus of claim 19, further comprising;

one or more first coupling parts to couple the supporting member and the first and second members in order through the first coupling holes.

21. The apparatus of claim 20, further, comprising;

one or more second coupling parts to couple the third, second, and first members and the supporting members in order through the second coupling holes.

* * * * *